US007255165B2

(12) United States Patent
Abdo et al.

(10) Patent No.: US 7,255,165 B2
(45) Date of Patent: Aug. 14, 2007

(54) FIELD-INSTALLABLE ROD GUIDE

(75) Inventors: Gary E. Abdo, Edmond, OK (US); Tom Evans, Edmond, OK (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 333 days.

(21) Appl. No.: 10/883,140

(22) Filed: Jul. 1, 2004

(65) Prior Publication Data

US 2006/0000602 A1 Jan. 5, 2006

(51) Int. Cl.
*E21B 17/00* (2006.01)

(52) U.S. Cl. ..... 166/241.3; 166/241.2; 166/241.4

(58) Field of Classification Search ..... 166/241.2; 175/73

See application file for complete search history.

(56) References Cited

U.S. PATENT DOCUMENTS 3,399,730 A * 9/1968 Pourchot ..... 166/176
4,343,518 A * 8/1982 Pourchot ..... 166/241.4
4,858,688 A 8/1989 Edwards et al.
5,339,896 A 8/1994 Hart et al.
5,494,104 A 2/1996 Sable, II
5,873,157 A * 2/1999 Hart et al. ..... 29/402.08
5,941,312 A * 8/1999 Vermeeren ..... 166/378
6,152,223 A 11/2000 Abdo et al.
6,808,019 B1 * 10/2004 Mabry ..... 166/176

* cited by examiner

*Primary Examiner*—David Bagnell
*Assistant Examiner*—Brad Harcourt
(74) *Attorney, Agent, or Firm*—Browning Bushman P.C.

(57) ABSTRACT

A field-installable rod guide for a rod moveable within an oilfield tubular having an interior tubular surface for driving a downhole pump to pump liquids to the surface through the oilfield tubular. The rod guide comprises a body including interfitting body members. An outer tapered surface on one body member is engaged by an inner taper-engagement surface on the other body member, to urge the body members toward a rod gripping position about the rod. The mechanism disclosed provides a particularly strong engagement with the rod, so that the rod guide may be used for either reciprocating or rotating rods. For rotating type rod guides, an outer sleeve may be included about the body.

27 Claims, 9 Drawing Sheets

FIELD-INSTALLABLE ROD GUIDE

FIELD OF THE INVENTION

This invention relates generally to a rod guide, and more particularly to an improved rod guide having increased gripping power, suitable for both rotating and reciprocating rod applications.

BACKGROUND OF THE INVENTION

In the hydrocarbon recovery industry, pumps are used at the lower ends of wells to pump oil to the surface through production tubing positioned within a well casing. Power is transmitted to the pump from the surface using a rod string positioned within the production tubing. Rod strings include both "reciprocating" types, which are axially stroked, and "rotating" types, which rotate to power progressing cavity type pumps. The latter type is increasingly used, particularly in wells producing heavy, sand-laden oil or producing fluids with high water/oil ratios.

Both reciprocating and rotating rods benefit from the use of rod guides to protect the interior surface of the production tubing. In practice, sucker rods and production tubing do not hang perfectly concentrically within a well, in part because well bores are never perfectly straight. Direct contact between the rod and the production tubing during reciprocation or rotation, especially while immersed in a harsh fluid environment, would otherwise cause expensive damage to the tubing and the rod. Rod guides are therefore placed between the rod and the tubing as a low cost sacrificial wear member.

Some rod guides have a plurality of fins projecting radially toward the ID of the production tubing, to center the rod within the tubing. The space between fins then provides a flow path for drilling fluid or hydrocarbon production flowing through the tubing. U.S. Pat. No 6,152,223 to Abdo describes such a rod guide, incorporating a low-friction wear material and a fin construction affording generous flow through. Other rod guides have a generally cylindrical outer surface having an OD substantially less than the ID of the production tubing, such that there is ample space between the guide and the tubing as a flow path. The disadvantage of this type of guide is there is less erodible wear volume ("EWV") in the guide, which leads to greater frequency of replacement and associated costs.

Many rod guides require at least some assembly to the rod prior to being transported to the field where they will be used. U.S. Pat. No. 5,941,312 to Vermeeren and U.S. Pat. No. 5,339,896 to Hart, et. al, each disclose examples of such "partially field-installable" rod guides. A spool is mechanically bonded to the rod in a shop or manufacturing facility. When in the field, an outer rod guide body may be later snapped over the spool affixed to the rod.

The Hart patent describes a rod guide having embodiments for use with both rotating and reciprocating rods. The embodiment of the outer guide body depends on whether it is to be used with a reciprocating or rotating rod. For example, for a rotating embodiment, the body and spool may rotate freely with respect to each other, which is generally preferred for all rotating type rod guides. As the rod rotates, the spool remains stationary with respect to the rod, while the outer body is free to rotate about the spool to remain nearly stationary with respect to a sidewall of the production tubing, minimizing wear between the body and the tubing, and between the spool and the rod. The majority of the wear instead occurs between the low cost sacrificial spool and guide body. For a reciprocating embodiment, the spool may include an elongate projection, and the outer guide body may include a slot for mating with the projection, such that the guide body does not rotate with respect to the spool.

To minimize manufacturing and assembly costs, some existing rod guides can be installed entirely in the field. U.S. Pat. No. 4,858,688 to Edwards, et al. and U.S. Pat. No. 5,494,104 to Sable each disclose examples of such "fully field-installable" rod guides. In each of these, a generally unitary body is provided with a bore for tightly positioning about a rod, and an access channel is provided from an outer surface of the body to the bore, allowing the guide to be forcibly "snapped-on" in the field. A problem inherent to each of these rod guides is that the single-piece body must be flexed when snapped onto the rod, weakening the gripping power of the guide. The Sable patent strives to minimize this drawback, by providing a non-circular bore to place more material at the area of highest flex. Although this potentially improves the gripping power of the guide, the presence of the access channel remains a source of structural weakness during the service life of the guide. A further shortcoming of these single-piece snap-on rod guides is that a single-piece body is generally best suited for reciprocating-type rods, and is non-ideal for use with rotating type rods.

U.S. Pat. No. 4,343,518 discloses another type of fully field-installable rod guide that does not require an access channel for installation. Instead, the rod guide comprises two half sections which are adapted to be lockingly clamped together. One half section has grooves and the other half section includes flanges having complementary tapered surfaces so that when the two half sections are moved together vertically the flanges are wedged in the grooves to clamp the two half sections together about the rod. The tapered surfaces are very narrow, however, and do not alone produce sufficient gripping power. The half sections may use inner ridges on semi-circular recesses for contacting the rod, to cause the recesses to deform into an elliptical shape to resist slippage. Another shortcoming of the rod guide is that it is described for use only with a reciprocating type rod, and is unsuitable for use with a rotating type rod.

A rod guide is desired that is fully field-installable, useful with both reciprocating and rotating rods, and having an improved mechanism for attaching the guide to the rod.

SUMMARY OF THE INVENTION

A field-installable rod guide is disclosed for a rod having an outer rod surface and movable within an oilfield tubular having an interior tubular surface for driving a downhole pump to pump liquids to the surface through the oilfield tubular.

In one embodiment the rod guide comprises a body including first and second interfitting body members. The first body member has an outer wear surface; a pair of circumferentially spaced outer tapered surfaces radially inward of the outer wear surface and tapering radially along an axial direction, the outer tapered surfaces extending circumferentially a combined at least 70 degrees toward one another from circumferentially outer locations no greater than 180 degrees apart to circumferentially inner locations; and an inner rod-engagement surface radially inward of the outer tapered surfaces, for gripping the outer rod surface. The second body member has an outer wear surface, an inner taper-engagement surface radially inward of the outer wear surface, for axially slidably engaging the outer tapered surfaces of the first body member, to urge the first and second body member radially inward toward one another and to deform at least a portion of the first body member radially inward toward a rod gripping position about the rod; and an inner rod-engagement surface radially inward of the inner taper-engagement surface for gripping the outer rod surface. A locking member may be included for axially locking the first and second body member with respect to one another.

The second body member may also have a pair of circumferentially spaced outer tapered surfaces radially inward of the outer wear surface and tapering radially along an axial direction, the outer tapered surfaces extending circumferentially a combined at least 70 degrees toward one another from circumferentially outer locations no greater than 180 degrees apart to circumferentially inner locations. Likewise, the first body member may have an inner taper-engagement surface radially inward of its outer wear surface, for axially slidably engaging the pair of outer tapered surfaces of the second body member, to both urge the first and second body member radially inward toward one another and deform at least a portion of the second body member radially inward toward a rod gripping position about the rod.

The tapered surface outer locations of the first body member may be circumferentially spaced less than 5 degrees from adjacent tapered surface outer locations of the second body when the body is in the rod gripping position. Each outer tapered surface may circumferentially extend at least about 35 degrees.

Radially projecting portions may be included along the inner rod-engagement surfaces for increasing friction between the body and the rod. These may comprise axially-spaced ribs or a knurled surface.

For use especially with rotating type rod guides, a sleeve may be included for positioning about the first and second body member while in the rod gripping position. The sleeve may include an inner wear surface for slidably contacting the outer wear surfaces of the first and second body members, and an outer wear surface for slidably contacting the interior tubular surface of the oilfield tubular. One or more stops on the body limit axial motion of the sleeve with respect to the body.

A plurality of fins may be included for centering the rod within the interior tubular surface of the oilfield tubular. The fins may be included directly on the body, especially for reciprocating rod guides, or on the sleeve, for rotating rod guides.

The foregoing is intended to summarize the invention, and not to limit nor fully define the invention. The aspects of the present invention will be more fully understood and better appreciated by reference to the following description and drawings.

DETAILED DESCRIPTION OF PREFERRED EMBODIMENTS

Figure 1:
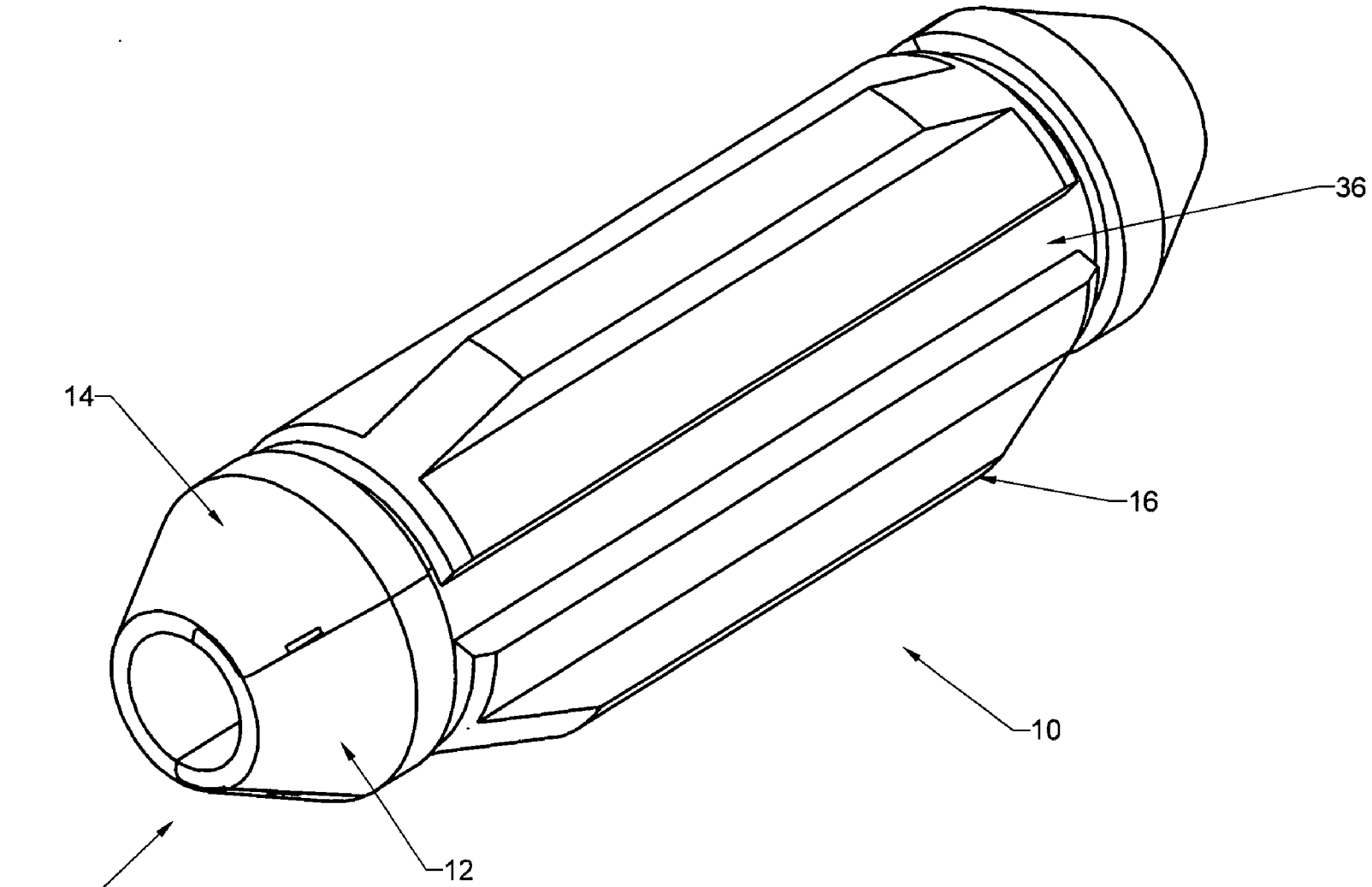
FIG. 1 shows a preferred embodiment for a rotating type rod guide, with both body members slid together to form the body and an outer sleeve about the body.

FIG. 1 shows a preferred embodiment for a rotating type rod guide 10, assembled with interfitting first and second body members 12, 14 slid together to form a generally cylindrical body 13, and an outer sleeve 16 positioned about the body 13. The rod guide 10 in general protects the rod and an interior bore of an oilfield tubular while the rod is moved within the tubular to power a pump. The rod guide embodied in FIG. 1 is particularly useful as a rotating type rod guide, because the body 13 may rotate freely within the sleeve 16 discussed below.

Figure 2:
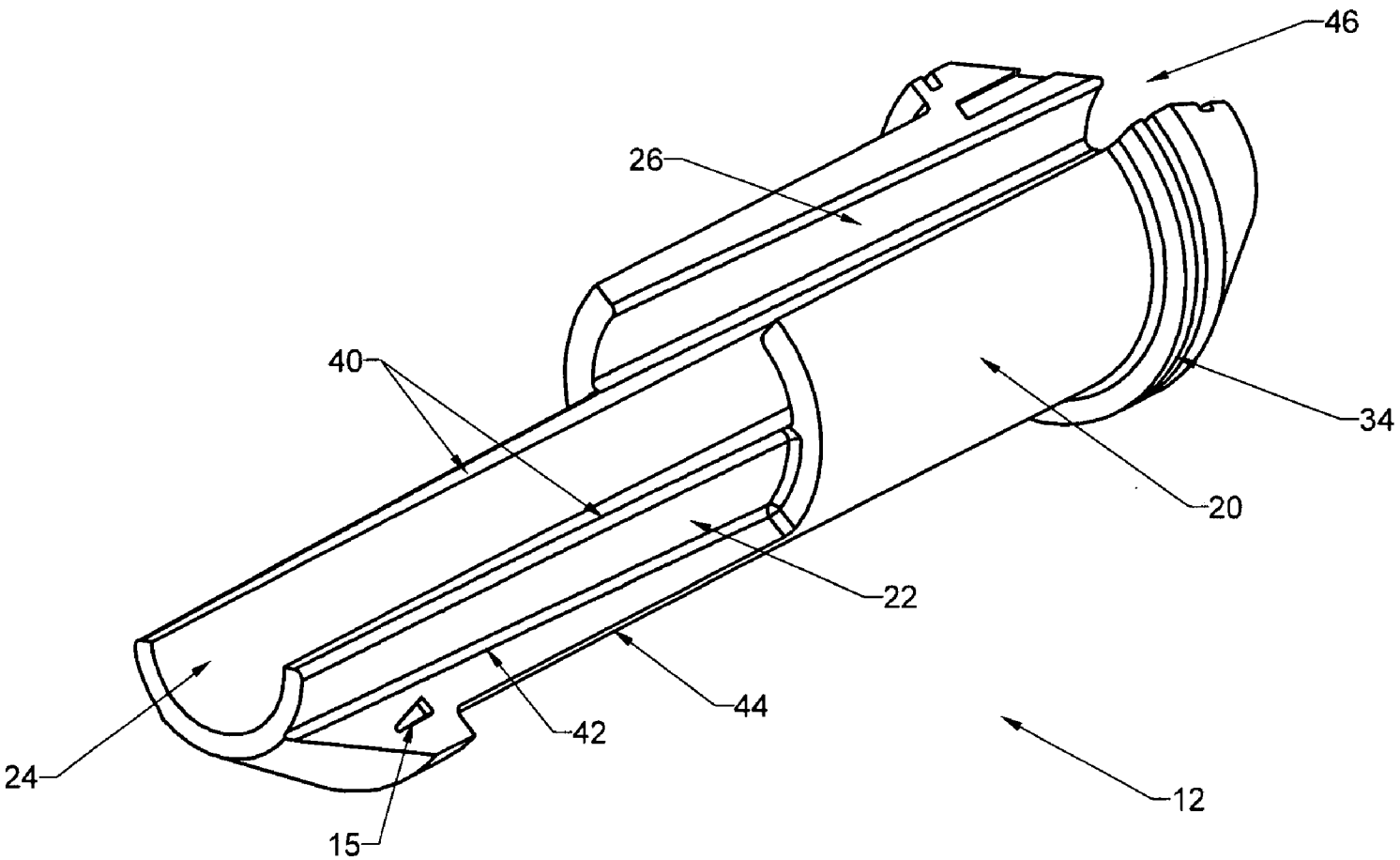
FIG. 2 shows a perspective view of one of the body members of FIG. 1.

FIG. 2 shows in greater detail the first body member 12 of FIG. 1. The first body member 12 is preferably substantially identical to the second body member 14, and for the purpose of discussion the first and second body members 12, 14 may be assumed to include the same features, except where noted. The first body member 12 includes an outer wear surface 20, at least one outer tapered surface 22 radially inward of the outer wear surface 20, tapering radially along an axial direction, and an inner rod-engagement surface 24 radially inward of the outer tapered surface 22, for gripping an outer surface of a rod (not shown). The second body member 14 includes the outer wear surface 20, an inner taper engagement surface 26 radially inward of the outer wear surface 20, for axially slidably engaging the at least one outer tapered surface 22 of the first body member 12, and the inner rod-engagement surface 24 radially inward of the inner taper engagement surface 26. Because the body members 12, 14 of this preferred embodiment are substantially identical, each of them thus includes the outer wear surface 20, the outer tapered surface 22, the inner rod-engagement surface 24, and the inner taper-engagement surface 26.

Figure 3:
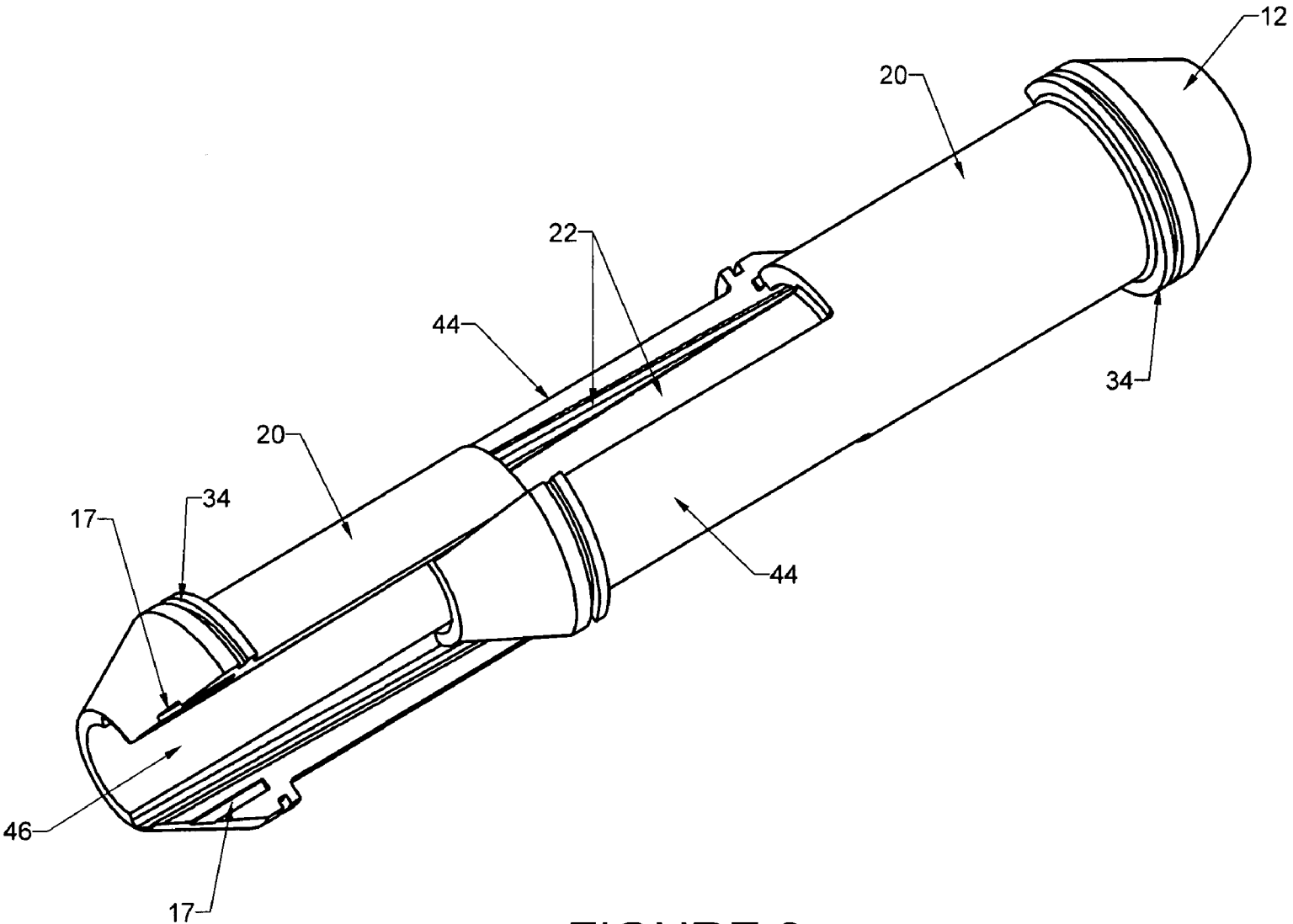
FIG. 3 shows a perspective view of the body members of FIG. 1 partially slid together.

FIG. 3 illustrates how the first and second body member 12, 14 cooperate. The first body member 12 is shown partially slid together with the second body member 14, between which a rod may be positioned (not shown). As the body members 12, 14 are axially slid together, the inner taper engagement surface 26 on one body member 12, 14 axially slidably engages the at least one outer tapered surface 22 of the other body member 12, 14. This engagement draws the body members 12, 14 toward a strong, frictional engagement about the rod.

Figure 4:
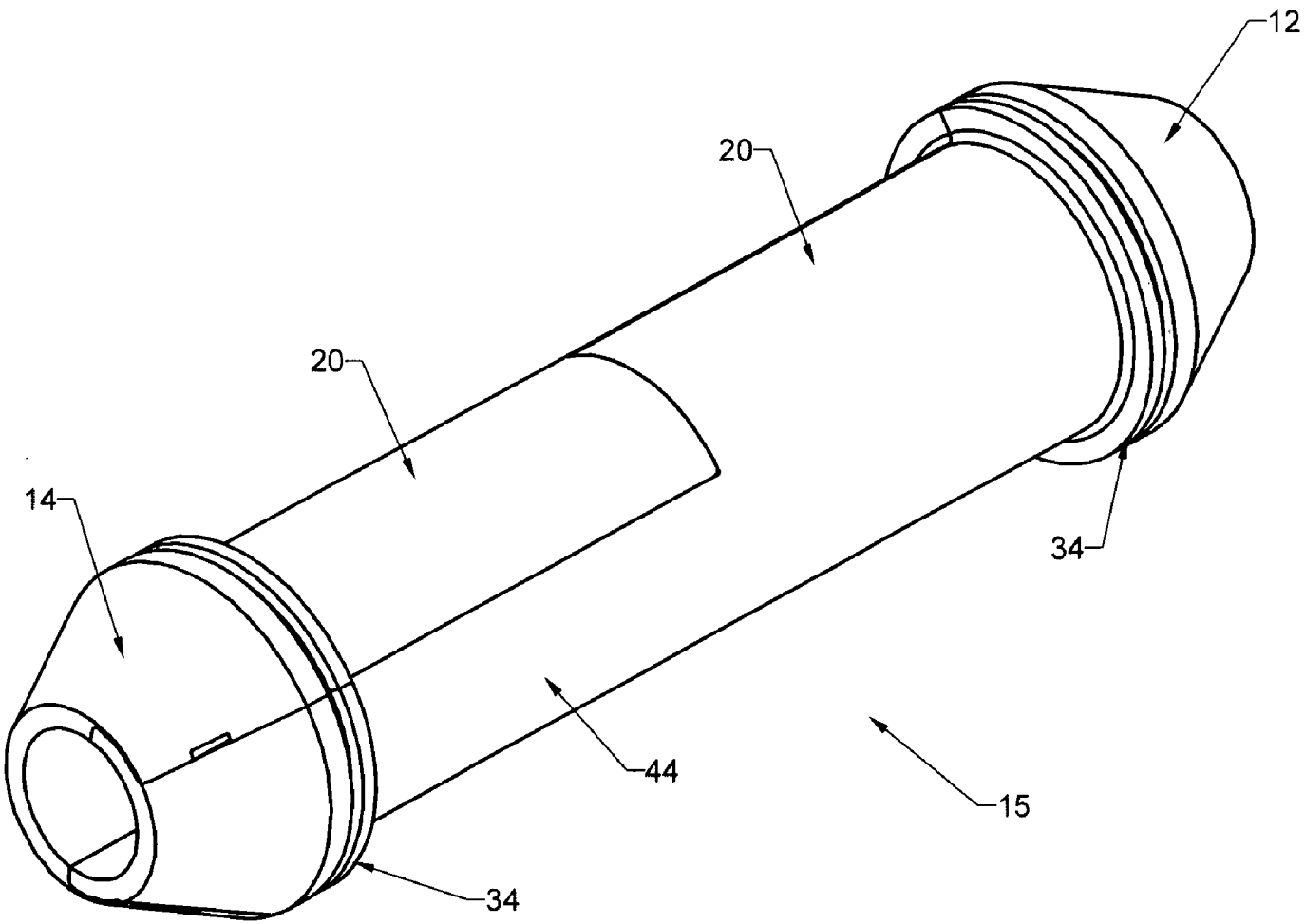
FIG. 4 shows a perspective view of both body members of FIG. 1 fully slid together to form a body.

FIG. 4 shows a perspective view of body members 12, 14 fully slid together to form the body 13. The body 13 thus has the substantially continuous outer wear surface 20 comprising the outer wear surfaces 20 of the individual body members 12, 14. The body is locked together with optional locking members, which are shown as a radially projecting snap 15 on the first body member 12 (see FIG. 2) and a corresponding recess 17 on the second body member 14 (see FIG. 3) for receiving the snap 15. This gripping position is discussed in more detail below, in terms of how the rod guide 10 allows a tight, secure fit that is capable of withstanding large axial and rotational forces.

Figure 5:
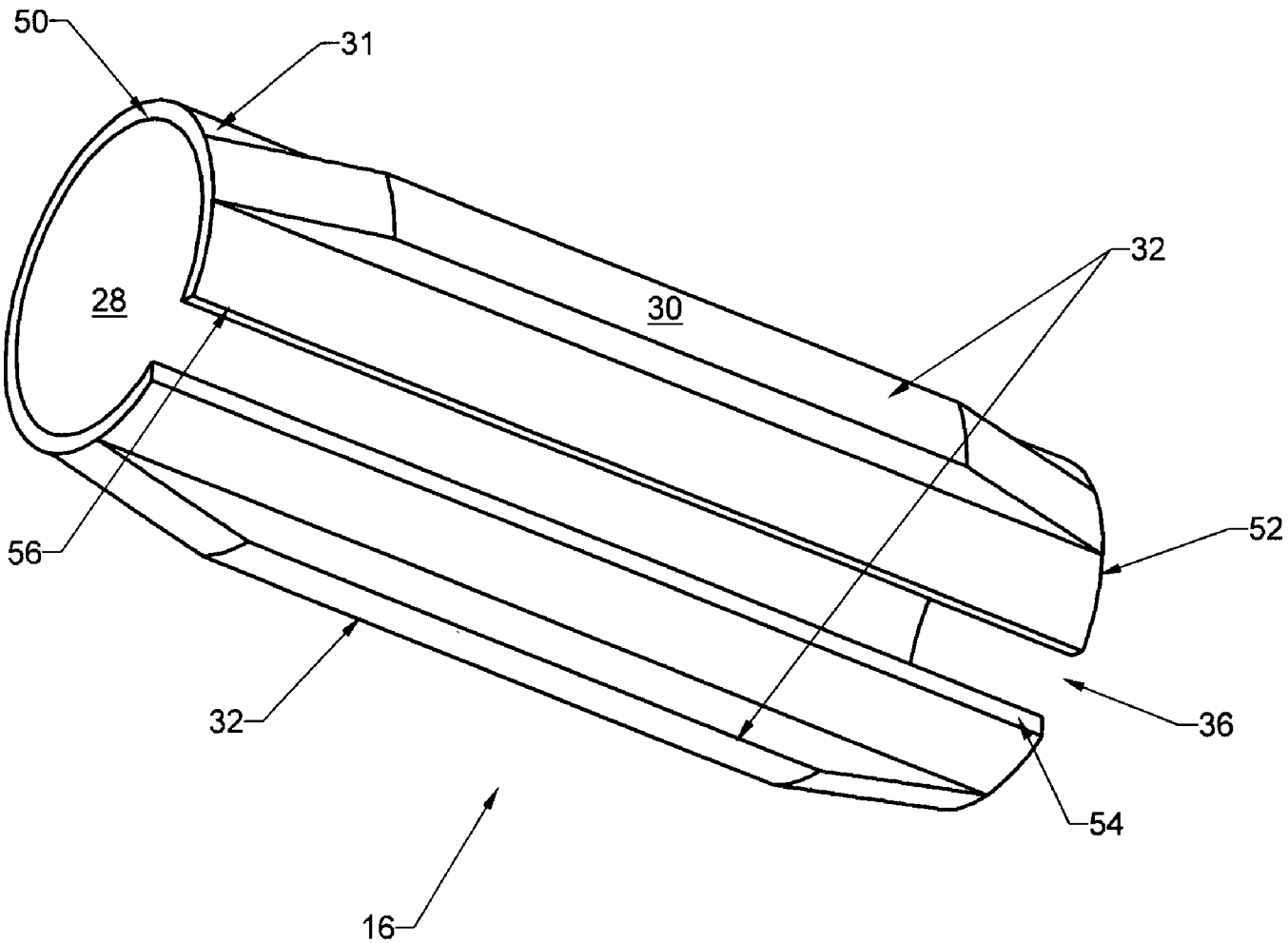
FIG. 5 shows a perspective view of the sleeve of FIG. 1.

FIG. 5 shows a perspective view of the sleeve 16 used in the embodiment of FIG. 1. The sleeve 16 has a plurality of radially projecting fins 32. The sleeve 16 includes an inner wear surface 28 for slidably contacting the outer wear surface 20 of the body 13 and an outer wear surface 30 on a radially outward portion of the plurality of fins 32 in the embodiment shown. In less preferred embodiments fins 32 may be excluded, and an outer surface located at a radially outermost location 31 may alternatively serve as the outer wear surface. The outer wear surface 30 is for contacting the interior tubular surface of the oilfield tubular (not shown). One or more stops 34 are preferably included on the body 13 for limiting axial motion of the sleeve 16 with respect to the body 13. The stops 34 as shown are a pair of axially spaced load shoulders 34 spaced a distance equal or greater than a length of the sleeve 16. An access channel 36 is also preferably included with the sleeve 16, for permitting installation of the sleeve 16 on the assembled body 13. As shown, the access channel 36 passes radially through the sleeve 16, partially severing the sleeve 16 to create circumferential side surfaces 54, 56, and extends longitudinally from one end 50 of the sleeve 16 to an opposing end 52 of the sleeve 16. Although the channel 36 in a relaxed state may be more narrow than an OD of the body 13, the channel 36 permits flexibly spreading of the sleeve 16 to move apart circumferential side surfaces 54, 56 and pass the body 13 through the access channel 36. The channel 36 may also be merely a cut, having a small or even nominally zero thickness, such that no appreciable spacing exists between circumferential side surfaces 54, 56. Thus, by spreading the sleeve 36, such as by flexing by hand, the sleeve 16 may be installed about the body 13. The spreading force applied to the sleeve 16 may then be released, allowing the sleeve to retract about the body 13.

Figure 9:
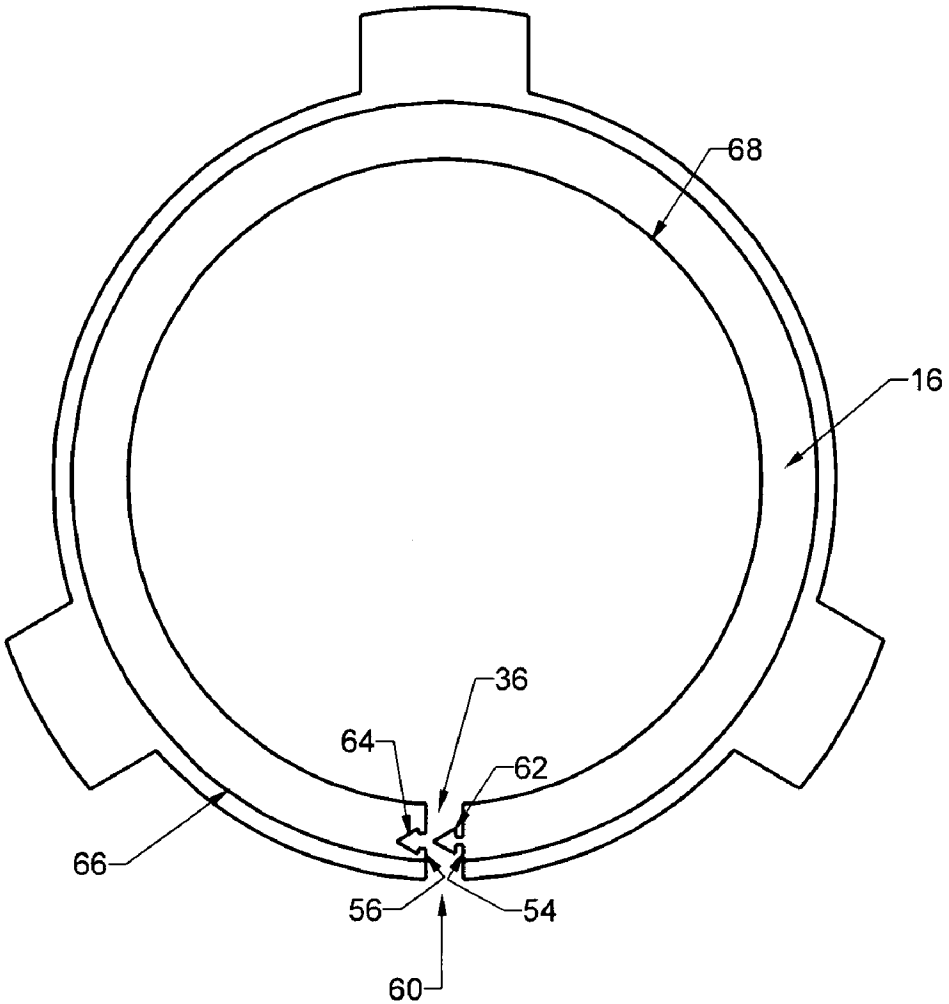
FIG. 9 shows a sleeve embodiment including a locking bridge for limiting outward flexing of the sleeve.

Because the channel 36 allows outward flexing of the sleeve 16, the sleeve 16 may flex and move about the body 13 during use. This creates a possibility of increased wear between the sleeve 16 and the body 13, and the possibility that the sleeve 16 may inadvertently come off the body 13. To decrease the chance of these occurring, a locking bridge may be included, as shown generally at 60 in the cross-sectional view of the sleeve embodiment of FIG. 9. The locking bridge 60 may selectively bridge the access channel 36 to at least limit outward spreading of the sleeve 16, i.e., at least limit circumferential separation of circumferential side surfaces 54, 56, and in some embodiments to draw the circumferential side surfaces 54, 56 toward one another. For example, as shown, the locking bridge 60 comprises a male member 62 secured to the sleeve 16 and a female member 64 secured to the sleeve 16 for lockingly receiving the male member 62. The locking bridge 60 may comprise a plurality of members axially spaced along the sleeve, or the locking bridge 60 may have an axial length that is a considerable fraction of the length of the sleeve, such as between 50-100% of the length of the sleeve.

In the preferred embodiment shown, the male member 62 and the female member 64 are positioned within the access channel 36 between arcuate surfaces 66, 68, each secured to a respective one of the circumferential side surfaces 54, 56. The male member 62 locks into a similarly shaped female member 64, bridging the channel 36, and limiting spreading of the sleeve 16. Preferably, this locking moves circumferential side surfaces 54, 56 into contact with one another, to seal or at least limit passing of sand, fluid, and debris through the channel 36. In other embodiments, the locking bridge may be secured elsewhere on the sleeve 16, such as on arcuate surface 66, to draw surfaces 54, 56 toward one another and bridge the channel 36. For example, in one embodiment (not shown), two members may be secured to the surface 66 opposite the channel 36 from one another, and a buckle included for fastening the two members, to both bridge the channel 36 and preferably draw surfaces 54, 56 toward one another.

Figure 7:
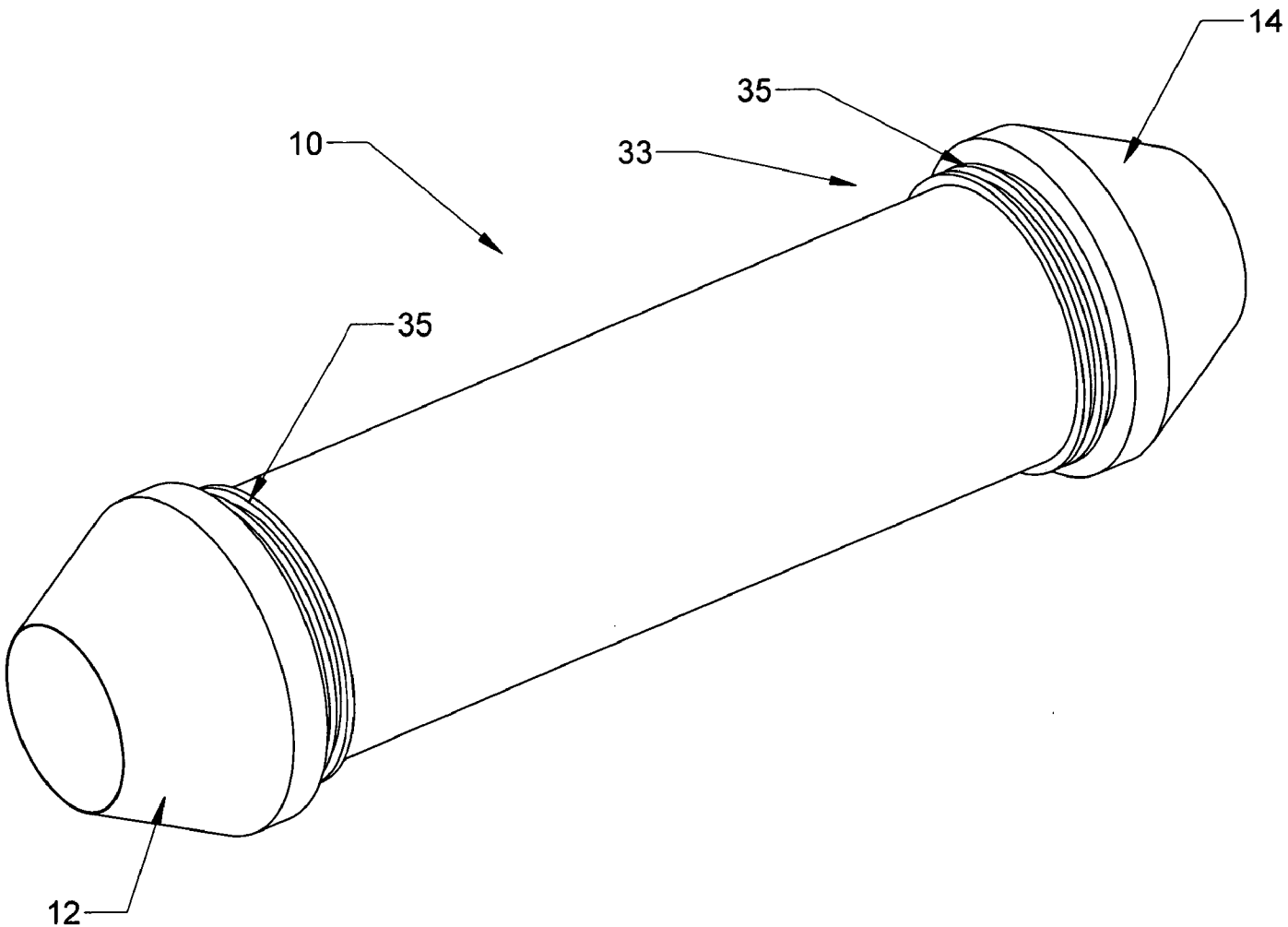
FIG. 7 shows the rod guide including a pair of axially spaced seal grooves.
Figure 8:
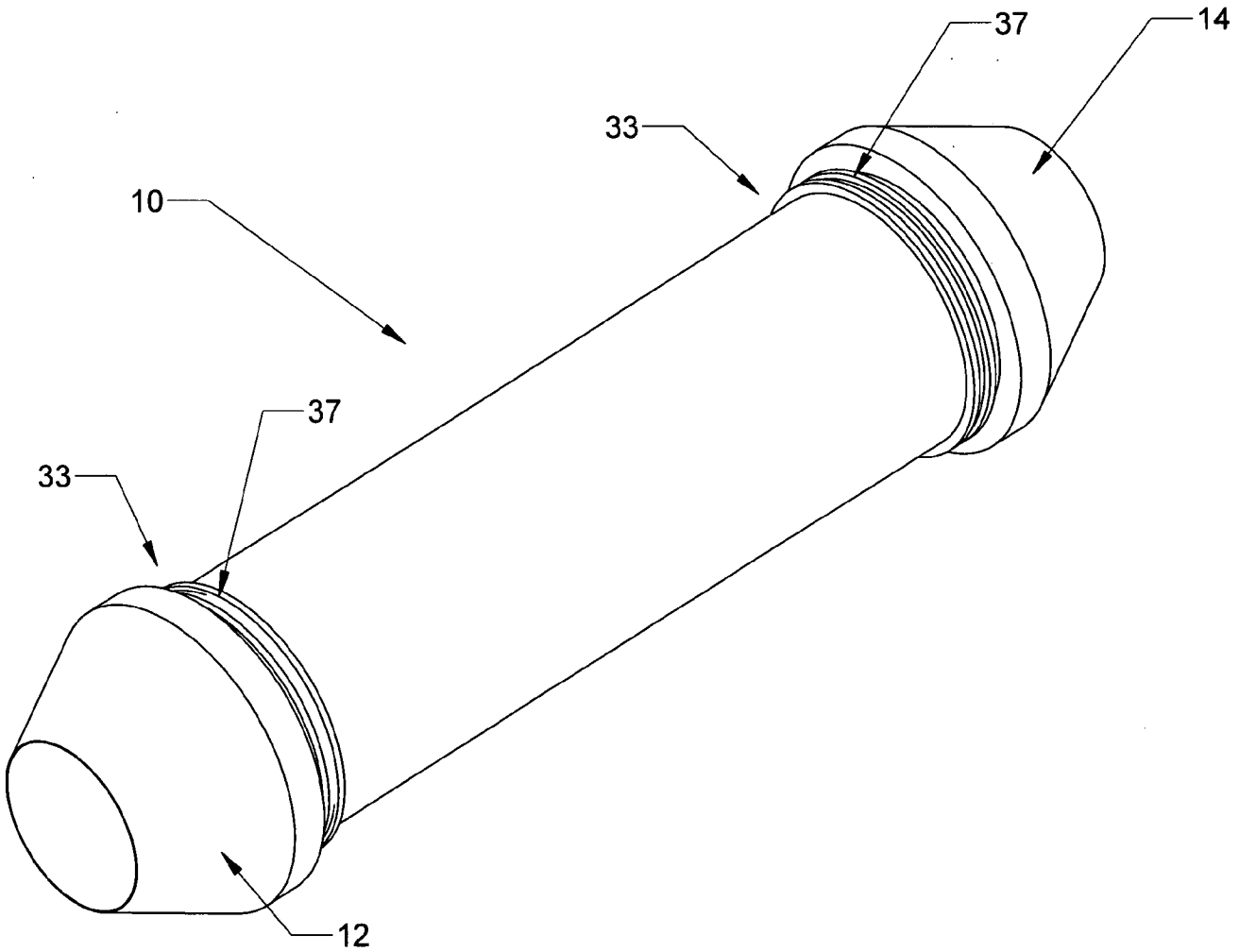
FIG. 8 shows the rod guide including a pair of axially spaced seal members received by a respective one of the axially spaced seal grooves.

Progressive cavity pumps are sometimes used in sand applications because they are able to move fluid with sand therein. FIGS. 7 and 8 show another embodiment of the rod guide 10 including a pair of axially spaced seal assemblies indicated generally at 33, circumferentially sealing between the body 13 and the sleeve 16, each seal assembly 33 being positioned at opposing ends of the outer wear sleeve 16. Each seal 37 (FIG. 8) seals with a respective one of a pair of axially spaced circumferential grooves 35 (FIG. 7). The grooves 35 are preferably positioned radially outward of the outer wear surfaces 20, for increasing resistance to intrusion by sand. The seals 37 are preferably elastomeric o-rings, but may also be other types of seals known in the art, such as lip seals.

In other embodiments (not shown), the seal assemblies 33 can instead be located on or adjacent to load shoulders 34. For example, a grooves can be included on shoulder 34, and still accommodate a circular seal, such as an o-ring or lip seal, to seal with sleeve ends 50,52.

Figure 6:
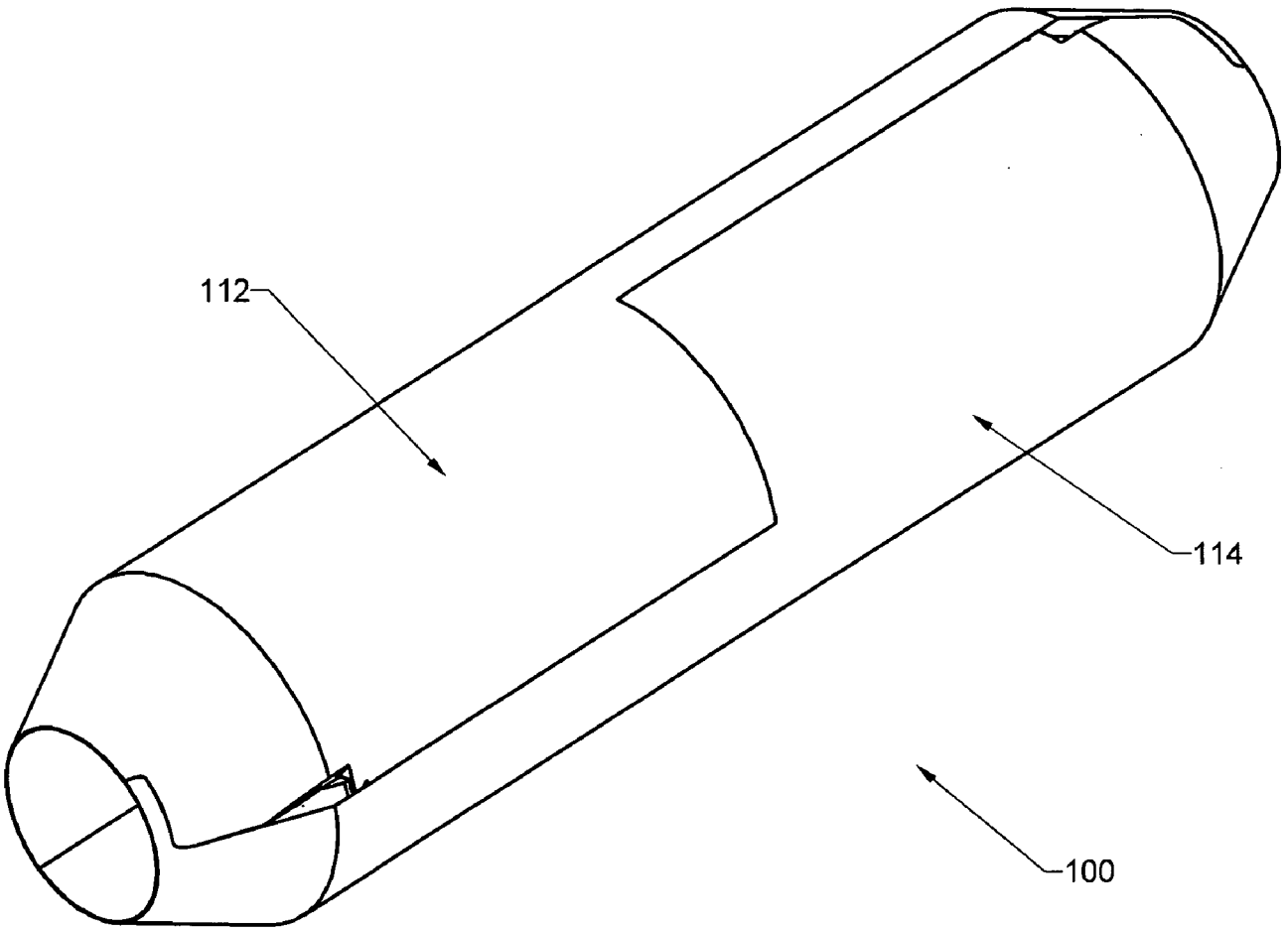
FIG. 6 is a perspective view of a less preferred embodiment of a reciprocating type rod guide not having a sleeve.

FIG. 6 illustrates a less preferred alternative embodiment of a rod guide 100 for a reciprocating type rod. Body members 112, 114 include the same features described for engaging body members 12, 14 of the rotating type rod guide 10, but lack the sleeve 16 or stops 34 of that other embodiment. Radially projecting fins similar to fins 32 may be included (but are not shown) directly on the body 13. However, some embodiments having a sleeve 16 as in FIGS. 1-5 may also be used with a reciprocating type rod. This would decrease tooling and associated costs, because the same body 13 and sleeve 16 may then be used for both rotating and reciprocating type rods. Because the sleeve 16 may already have fins 32, use of the sleeve 16 with reciprocating rods would eliminate the need for a separate rod guide embodiment having fins directly on the body 13.

The at least one outer tapered surface 22 of the first and second body members 12, 14 are preferably a pair of circumferentially spaced outer tapered surfaces 22, as shown in FIG. 1. The pair of outer tapered surfaces 22 should circumferentially extend at least a combined 70 degrees from circumferentially outer locations 40 no greater than 180 degrees apart to circumferentially inner locations 42. The outer tapered surfaces 22 preferably extend at least a combined 90 degrees, as shown. Individually, each outer tapered surface 22 should extend circumferentially at least 35 degrees, and preferably at least 45 degrees as shown, i.e. the distance between the outer location 40 and inner location 42 of each tapered surface 22 is preferably at least 35-45 degrees. As best seen in FIG. 3, the circumferentially outer locations 40 of the first body member 12 may be spaced very closely (preferably less than 5 degrees) to adjacent circumferentially outer locations 40 of the second body member, creating a substantially continuous outer tapered surface 22. This novel geometry is largely responsible for the rod guide's strong engagement with the rod. First, the circumferentially outer locations 40 of the tapered outer surfaces 22 cause the body members to deform inwardly in proximity to the circumferentially outer locations 40. This deformation pinches the rod at these locations 40 and may induce a non-circular inner rod-engagement surface 24, to increase frictional engagement with the rod. Second, because opposing tapered surfaces 22 circumferentially extend to circumferentially inner locations 42 spaced less than 180 degrees, the opposing tapered surfaces 22 induce a radially inward force component to draw the body members 12, 14 radially inward toward one another about the rod. Third, because each tapered surface 22 preferably extends at least 45 degrees, and a combined distance of at least about 90 degrees, a gripping force is applied over a large area of the rod. As compared with the prior art, this causes a stronger total force and results in a very robust engagement with the rod. As discussed further below, these features are therefore highly important for use with reciprocating type rod guides, which may experience higher forces downhole than do rotatable rod guides.

As best seen in FIGS. 3 and 4, an intermediate flange 44 may be included, extending between the pair of outer tapered surfaces 22 of the first and second body members 12, 14. The intermediate flange 44 defines a portion of the outer wear surface 20. An intermediate channel 46 may also be included, dividing a portion of the outer wear surface 20, such that the channel 46 on one body member 12, 14 receives the intermediate flange 44 on the other body member 12, 14. The intermediate flange 44 of one body member 12, 14 preferably substantially fills the intermediate channel of the other body member 12, 14, forming a substantially continuous combined outer wear surface 20 along a circumferential direction. In simple terms, this feature is what helps the substantially identical body members 12, 14 "fit together" to form a single body 13 having a continuous outer wear surface 20.

In the preferred embodiments, as discussed, the body members 12, 14 are substantially identical. Thus, each body member 12, 14 has an outer wear surface 20, a pair of outer tapered surfaces 22, an inner taper engagement surface 26 for engaging the outer tapered surfaces 22 of the other body member 12, 14, and an inner rod-engagement surface 24. In less preferred embodiments, however, the invention may work conceptually with less symmetry and identity between parts. At a minimum, the first body member 12 should include the outer wear surface 20, the at least one outer tapered surface 22, and the inner rod-engagement surface 24, and the second body member 14 should include the outer wear surface 20, the inner taper-engagement surface 26, and the inner rod-engagement surface 24. In other words, only one of the body members 12, 14 needs the outer tapered surface 22, and the other of the body members 12, 14 needs the taper-engagement surface 26.

A reciprocating type rod guide 100 may require greater holding power than a rotating type guide 10, due to the large axial forces of the former as compared with the low rotational forces of the latter. Thus, the aspects of the invention discussed above whereby the outer tapered surfaces 22 provide large gripping power is particularly advantageous for reciprocating type guides 100.

Although specific embodiments of the invention have been described herein in some detail, it is to be understood that this has been done solely for the purposes of describing the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from the spirit and scope of the invention.

The invention claimed is:

1. A field-installable rod guide for a rod having an outer rod surface, the rod rotatable within an oilfield tubular having an interior tubular surface for driving a rotating-type downhole pump to pump liquids to the surface through the oilfield tubular, the rod guide comprising:

a body including interfitting first and second body members;

the first body member having a. an outer wear surface;

b. at least one outer tapered surface radially inward of the outer wear surface, tapering radially along an axial direction;

c. an inner rod-engagement surface radially inward of the outer tapered surface, for gripping the outer rod surface; and d. a first body load shoulder radially outward of the outer wear surface;

the second body member having a. an outer wear surface;

b. an inner taper-engagement surface radially inward of the outer wear surface, for axially slidably engaging the at least one outer tapered surface of the first body member, to urge at least a portion of the body radially inward toward a rod gripping position about the rod; and c. an inner rod-engagement surface radially inward of the inner taper-engagement surface for gripping the outer rod surface; and d. a second body load shoulder radially outward of the outer wear surface, the first body load shoulder axially spaced from the second body load shoulder;

a sleeve for positioning about the first and second body member while in the rod gripping position and between the axially spaced load shoulders, the sleeve including an inner wear surface for slidably contacting the outer wear surfaces of the first and second body members, and an outer wear surface for contacting the interior tubular surface of the oilfield tubular.

2. A rod guide as defined in claim 1, further comprising:

the second body member having at least one outer tapered surface radially inward of its outer wear surface, tapering radially along an axial direction; and the first body member having an inner taper-engagement surface radially inward of its outer wear surface, for axially slidably engaging the at least one outer tapered surface of the second body member, to urge the first and second body member radially inward toward the rod gripping position about the rod.

3. A rod guide as defined in claim 1, wherein the at least one outer tapered surface of the first body is an arcuate surface.

4. A rod guide as defined in claim 1, wherein the at least one outer tapered surface further comprises:

a pair of circumferentially spaced outer tapered surfaces circumferentially extending a combined at least 70 degrees from respective circumferentially outer locations no more than 180 degrees apart toward respective circumferentially inner locations.

5. A rod guide as defined in claim 4, further comprising:

the second body member having a pair of circumferentially spaced outer tapered surfaces radially inward of the outer wear surface and tapering radially along an axial direction, the outer tapered surfaces circumferentially extending a combined at least 70 degrees from respective circumferentially outer locations no more than 180 degrees apart toward respective circumferentially inner locations; and the first body member having an inner taper-engagement surface radially inward of its outer wear surface, for axially slidably engaging the pair of outer tapered surfaces of the second body member, to both urge the first and second body member radially inward toward one another and deform at least a portion of the second body member radially inward toward a rod gripping position about the rod.

6. A rod guide as defined in claim 5, wherein the outer tapered surfaces of the first and second body members each circumferentially extend at least about 35 degrees.

7. A rod guide as defined in claim 5, wherein the circumferentially outer locations on the tapered surface of the first body member are circumferentially spaced less than 5 degrees from adjacent circumferentially outer locations on the tapered surface of the second body when the body is in the rod gripping position.

8. A rod guide as defined in claim 1, further comprising:

a locking member opposite the sleeve with respect to a load shoulder for axially locking the first and second body member with respect to one another.

9. A rod guide as defined in claim 8, wherein the locking member comprises one or more radially projecting snaps on one of the first and second body member and a corresponding one or more recesses on the other of the first and second body member, each for receiving a respective radially projecting snap.

10. A rod guide as defined in claim 1, further comprising:

radially projecting portions along the inner rod-engagement surfaces for increasing friction between the body and the rod.

11. A rod guide as defined in claim 1, wherein the sleeve further comprises:

an access channel extending longitudinally from one end of the sleeve to an opposing end of the sleeve, for permitting spreading of the sleeve to pass the body through the access channel to install the sleeve about the body.

12. A rod guide as defined in claim 11, further comprising:

a locking bridge for selectively bridging the access channel to limit circumferential separation of circumferential side surfaces in the sleeve, the locking bridge comprises a first member secured to the sleeve and a second member secured to the sleeve opposite the access channel from the first sleeve for lockingly mating with the first member.

13. A rod guide as defined in claim 12, wherein the first member is secured to one of the side surfaces and the second member is secured to another of the side surfaces.

14. A rod guide as defined in claim 12, further comprising:

a pair of axially spaced seals circumferentially sealing between the body and the sleeve, each seal being positioned at opposing ends of the outer wear sleeve.

15. A rod guide as defined in claim 14, further comprising:

a pair of axially spaced circumferential grooves radially outward of the outer wear surfaces, each groove for sealing with a respective one of the axially spaced seals.

16. A rod guide as defined in claim 1, wherein the sleeve further comprises:

radially projecting fins for centering the rod within the interior tubular surface of the oilfield tubular, a radially outward portion of the radially projecting fins defining the outer wear surface of the sleeve.

17. A rod guide as defined in claim 1, wherein the first and second body are substantially identically shaped.

18. A field-installable rod guide for a rod having an outer rod surface, the rod rotatable within an oilfield tubular having an interior tubular surface for driving a rotating-type downhole pump to pump liquids to the surface through the oilfield tubular, the rod guide comprising:

a body including interfitting first and second body members;

the first body member having a. an outer wear surface;

b. a pair of circumferentially spaced outer tapered surfaces radially inward of the outer wear surface and tapering radially along an axial direction, the outer tapered surfaces circumferentially extending a combined at least 70 degrees from respective circumferentially outer locations no more than 180 degrees apart toward respective circumferentially inner locations;

c. an inner taper-engagement surface radially inward of its outer wear surface, for axially slidably engaging a pair of circumferentially spaced outer tapered surfaces of the second body member, to urge the first and second body toward the rod gripping position about the rod;

d. an inner rod-engagement surface radially inward of the outer tapered surface, for gripping the outer rod surface; and e. a first body load shoulder radially outward of the outer wear surface;

the second body member having a. an outer wear surface;

b. the pair of circumferentially spaced outer tapered surfaces radially inward of the outer wear surface and tapering radially along an axial direction, the outer tapered surfaces circumferentially extending a combined at least 70 degrees from respective circumferentially outer locations no more than 180 degrees apart toward respective circumferentially inner locations;

c. an inner taper-engagement surface radially inward of the outer wear surface, for axially slidably engaging the pair of circumferentially spaced outer tapered surfaces of the first body member, to urge the first and second body toward the rod gripping position about the rod; and d. an inner rod-engagement surface radially inward of the inner taper-engagement surface for gripping the outer rod surface; and e. a second body load shoulder radially outward of the outer wear surface, the first body load shoulder axially spaced from the second body load shoulder;

a locking member opposite the sleeve with respect to a load shoulder for axially locking the first and second body member with respect to one another;

a sleeve for positioning about the first and second body member while in the rod gripping position and between the axially spaced load shoulders, the sleeve including an inner wear surface for slidably contacting the outer wear surfaces of the first and second body members, and an outer wear surface for contacting the interior tubular surface of the oilfield tubular.

19. A rod guide as defined in claim 18, wherein the outer tapered surfaces of the first and second body members each circumferentially extend at least about 35 degrees.

20. A rod guide as defined in claim 18, wherein the circumferentially outer locations on the tapered surface of the first body member are circumferentially spaced less than 5 degrees from adjacent circumferentially outer locations on the tapered surface of the second body when the body is in the rod gripping position.

21. A field-installable rod guide for a rod having an outer rod surface, the rod rotatable within an oilfield tubular having an interior tubular surface for driving a rotating-type downhole pump to pump liquids to the surface through the oilfield tubular, the rod guide comprising:

a body including interfitting first and second body members;

the first body member having a. an outer wear surface;

b. at least one outer tapered surface radially inward of the outer wear surface, tapering radially along an axial direction; and c. an inner rod-engagement surface radially inward of the outer tapered surface, for gripping the outer rod surface;

the second body member having a. an outer wear surface;

b. an inner taper-engagement surface radially inward of the outer wear surface, for axially slidably engaging the at least one outer tapered surface of the first body member, to urge at least a portion of the body radially inward toward a rod gripping position about the rod; and c. an inner rod-engagement surface radially inward of the inner taper-engagement surface for gripping the outer rod surface; and a sleeve for positioning about the first and second body member while in the rod gripping position, the sleeve including an inner wear surface for slidably contacting the outer wear surfaces of the first and second body members, and an outer wear surface for contacting the interior tubular surface of the oilfield tubular;

an access channel extending longitudinally from one end of the sleeve to an opposing end of the sleeve, for permitting spreading of the sleeve to pass the body through the access channel to install the sleeve about the body; and a locking bridge for selectively bridging the access channel to limit circumferential separation of circumferential side surfaces in the sleeve.

22. A rod guide as defined in claim 21, wherein the first member is secured to one of the side surfaces and the second member is secured to another of the side surfaces.

23. A rod guide as defined in claim 21, further comprising:

a pair of axially spaced seals circumferentially sealing between the body and the sleeve, each seal being positioned at opposing ends of the outer wear sleeve.

24. A rod guide as defined in claim 23, further comprising:

a pair of axially spaced circumferential grooves radially outward of the outer wear surfaces, each groove for sealing with a respective one of the axially spaced seals.

25. A rod guide as defined in claim 21, further comprising:

the second body member having at least one outer tapered surface radially inward of its outer wear surface, tapering radially along an axial direction; and the first body member having an inner taper-engagement surface radially inward of its outer wear surface, for axially slidably engaging the at least one outer tapered surface of the second body member, to urge the first and second body member radially inward toward the rod gripping position about the rod.

26. A rod guide as defined in claim 21, wherein the at least one outer tapered surface of the first body is an arcuate surface.

27. A rod guide as defined in claim 21, wherein the at least one outer tapered surface further comprises:

a pair of circumferentially spaced outer tapered surfaces circumferentially extending a combined at least 70 degrees from respective circumferentially outer locations no more than 180 degrees apart toward respective circumferentially inner locations.

* * * * *